US010876235B2

(12) United States Patent
Dinges

(10) Patent No.: US 10,876,235 B2
(45) Date of Patent: Dec. 29, 2020

(54) SEWING MACHINE AND METHOD FOR OPERATING THE SEWING MACHINE

(71) Applicants: Vetron Typical Europe GmbH, Kaiserslautern (DE); Faurecia Sièges D'Automobile, Nanterre (FR)

(72) Inventor: Michael Dinges, Winnweiler (DE)

(73) Assignees: Vetron Typical Europe GmbH, Kaiserslautern (DE); Faurecia Sièges D'Automobile, Nanterre (FR)

( * ) Notice: Subject to any disclaimer, the term of this patent is extended or adjusted under 35 U.S.C. 154(b) by 127 days.

(21) Appl. No.: 16/333,690

(22) PCT Filed: Sep. 14, 2017

(86) PCT No.: PCT/DE2017/100780
§ 371 (c)(1),
(2) Date: Mar. 15, 2019

(87) PCT Pub. No.: WO2018/050167
PCT Pub. Date: Mar. 22, 2018

(65) Prior Publication Data

US 2019/0264358 A1 Aug. 29, 2019

(30) Foreign Application Priority Data

Sep. 16, 2016 (DE) ..... 10 2016 117 483

(51) Int. Cl.
*D05B 27/06* (2006.01)
*D05B 21/00* (2006.01)
(Continued)

(52) U.S. Cl.
CPC ..... *D05B 27/06* (2013.01); *D05B 21/00* (2013.01); *D05B 21/002* (2013.01); *D05B 27/00* (2013.01);
(Continued)

(58) Field of Classification Search
CPC ..... D05B 27/06; D05B 21/00; D05B 35/00; D05B 27/00; B25B 11/002; D05D 2207/06
See application file for complete search history.

(56) References Cited

U.S. PATENT DOCUMENTS 3,954,071 A 5/1976 Mall et al.
4,074,640 A 2/1978 Chano et al.
(Continued)

FOREIGN PATENT DOCUMENTS

DE 23 61 375 B1 5/1975
DE 24 54 116 A1 5/1976
(Continued)

OTHER PUBLICATIONS

English translation of the International Preliminary Report on Patentability and Written Opinion of International Searching Authority in PCT/DE2017/100780, dated Mar. 28, 2019.
(Continued)

*Primary Examiner* — Tajash D Patel
(74) *Attorney, Agent, or Firm* — Collard & Roe, P.C.

(57) ABSTRACT

A sewing machine includes a support surface for two plies of material to be sewn together and a sewing mechanism that is attached to the support surface and is in operative connection with a machine controller, wherein a plate element positioned between the two material plies is arranged in the material feed area thereof. A vertical adjustment device for the plate element that is actuatable by the machine controller adjusts a vertical distance between the support surface and the plate element, and thus also influences the feed of material to the sewing mechanism. The vertical adjustment device is equipped with an electromagnet for adjusting the position of the plate element. The plate element is equipped with a magnet, which cooperates with the electromagnet.

9 Claims, 1 Drawing Sheet

(51) Int. Cl.

| | |
|---|---|
| ***D05B 27/24*** | (2006.01) |
| ***D05B 35/10*** | (2006.01) |
| ***D05B 35/00*** | (2006.01) |
| ***D05B 27/00*** | (2006.01) |

(52) U.S. Cl.
CPC ..... *D05B 27/24* (2013.01); *D05B 35/00* (2013.01); *D05B 35/10* (2013.01); *D05D 2207/06* (2013.01)

(56) References Cited

U.S. PATENT DOCUMENTS

| | | | | |
|---|---|---|---|---|
| 4,301,978 | A * | 11/1981 | Herr | D05B 47/00 112/254 |
| 4,649,837 | A * | 3/1987 | Futsuhara | D05B 21/00 112/470.06 |
| 4,658,741 | A | 4/1987 | Jehle et al. | |
| 4,867,087 | A | 9/1989 | Suzuki et al. | |
| 2009/0267277 | A1* | 10/2009 | Mack | B25B 11/002 269/8 |
| 2017/0096756 | A1* | 4/2017 | Makover | D05B 39/00 |
| 2018/0038027 | A1 | 2/2018 | Labes et al. | |

FOREIGN PATENT DOCUMENTS

| | | | |
|---|---|---|---|
| DE | 26 10 430 | A1 | 9/1976 |
| DE | 38 16 260 | A1 | 11/1988 |
| DE | 10 2015 102 342 | A1 | 8/2016 |
| KR | 2012-0048135 | A | 5/2012 |

OTHER PUBLICATIONS

International Search Report in PCT/DE2017/100780, dated Jan. 9, 2018.

* cited by examiner

SEWING MACHINE AND METHOD FOR OPERATING THE SEWING MACHINE

CROSS REFERENCE TO RELATED APPLICATIONS

This application is the National Stage of PCT/DE2017/100780 filed on Sep. 14, 2017, which claims priority under 35 U.S.C. § 119 of German Application No. 10 2016 117 483.1 filed on Sep. 16, 2016, the disclosure of which is incorporated by reference. The international application under PCT article 21(2) was not published in English.

The invention relates to a sewing machine according to the preamble of patent claim 1.

A sewing machine of the kind described is known from patent document DE 24 54 116 B2. This sewing machine consists of a support surface for the two plies of material to be sewn together and a sewing mechanism that is attached to the support surface and is in operative connection with a machine controller, wherein a plate element positioned between the two material plies is arranged in the material feed area thereof. In addition in this solution a vertical adjustment device for the plate element that is actuatable by the machine controller is provided to adjust a vertical distance between the support surface and the plate element, and thus also to influence the feed of material to the sewing mechanism, wherein said vertical adjustment device is equipped with an electromagnet for adjusting the position of the plate element. From column 5, row 1 to 4 of said document results, that the electromagnet is designed as a part of a magnetic valve, which serves to operate an air cylinder.

In addition, from the patent document DE 23 61 375 B1 a sewing machine with a plate element is known. In this solution, said plate element serves particularly as an abutment for the measuring wheels arranged above and below it.

The object underlying the invention is to improve a sewing machine of the kind described in the introduction. In particular, a sewing machine is to be created with which two plies of material may be sewn together precisely and fully automatically even when different materials are used and/or the contours of the two materials are incongruent.

This object is solved with a sewing machine of the kind described in the introduction and having the features listed in the characterising part of patent claim 1.

According to the invention, it is provided that the plate element is equipped with a magnet, which cooperates with the electromagnet.

In other words, the solution according to the invention is unique because the feed of both plies of material is affected with the aid of the plate element, whose distance from the support surface is adjustable. In this context, reducing the distance particularly causes the ply of material to be slowed down between the support surface and the plate element. When the distance is increased, the ply of material supported on the plate element—the upper material ply—is pressed against the presser foot or a counterbearing which will be explained in greater detail later in this document, and also slowed down. The general result of this arrangement is that it provides the capability to alter the feed of the two material plies to the sewing mechanism separately almost continuously, and thus also their position relative to each other for sewing together.

Other advantageous refinements of the sewing machine according to the invention are described in the dependent claims.

For the sake of completeness, reference is made to the following document:

A sewing machine having multiple plate elements in the area of the material feed is known from DE 38 16 260 A1. However, these plate elements are not adjustable.

In the following, the sewing machine according to the invention and the advantageous refinements thereof according to the dependent claims will be explained in greater detail with reference to the graphical representation of a preferred embodiment thereof.

Figure 1:
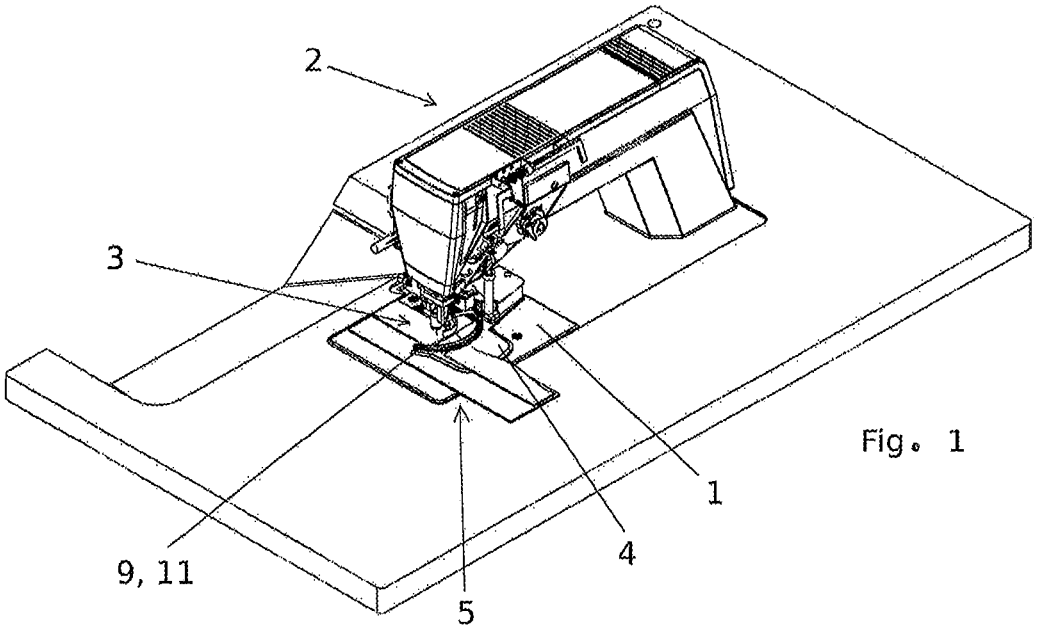
FIG. 1 is a perspective view of the sewing machine according to the invention with the height-adjustable plate element.

The sewing machine represented in FIG. 1 consists initially in known manner of a preferably horizontally aligned support surface 1 for two plies of material to be sewn together, and a sewing mechanism 3 which is attached to support surface 1 and is in operative connection with a typically electronically functioning machine controller 2, wherein a plate element 4 positioned between the two material plies is arranged in the material feed area thereof. As may be seen clearly in FIG. 2, at the same time it is particularly preferably provided that edges of plate element 4 on the material feed side are chamfered to ensure good feeding of the material. It is further preferably provided (see also FIG. 3) that an area of plate element 4 that is touched by the material plies as they are sewn together has a width B between 50 and 100 mm, a depth T between 20 and 70 mm and a thickness D between 1 and 5 mm.

It is further provided that a vertical adjustment device 5 for plate element 4 that may be actuated by machine controller 2 is provided for adjusting a vertical distance between support surface 1 and plate element 4, and thus also for altering the feed of material to sewing mechanism 3. In other words again, expressed in terms of process, the inventive device thus provides that the vertical distance between support surface 1 and plate element 4 is reduced to slow the lower material ply and increased to slow the upper material ply. The effect of these changes is to enable two plies of material to be sewn together precisely and fully automatically even when different materials are used and/or the contours of the two materials are incongruent.

As has already been indicated in the introduction, in this context the presser foot may serve as the abutment for plate element 4, for example. More generally, it is particularly preferably provided according to the invention that plate element 4 is arranged between support surface 1 and abutment 9.

As is known from the otherwise less closely related DE 10 2015 102 342 A1, an upper guide element 11, preferably with a shape that describes at least a part of a circle and which can be rotated about a vertical axis by machine controller 2, is particularly preferably (but not necessarily) provided above support surface 1 on the sewing machine according to the invention to rotate the upper material ply about a vertical axis (that is to say in a horizontal plane). In the solution according to FIG. 1, upper guide 11 forms the aforementioned abutment 9 for plate element 4. In addition thereto, with reference to FIG. 2 it is further particularly preferred to provide an abutment surface 4.4 on plate element 4 shaped to match top guide element 11.

Additionally, a lower guide element (not shown explicitly in the figures because it is known from DE 10 2015 102 342 A1), preferably with a shape that describes at least a part of a circle and which can particularly preferably be rotated about a vertical axis by machine controller 2, is provided in the support surface 1 to rotate the lower material ply about a vertical axis (that is to say in a horizontal plane).

The qualification "describing part of a circle" cited twice in the preceding description thus implies that the top and/or bottom guide element(s) may also be in the shape of complete rings. In the solution according to FIG. 1, the bottom guide element is in the form of a complete ring, and the top guide element is designed as a partial ring.

Figure 3:
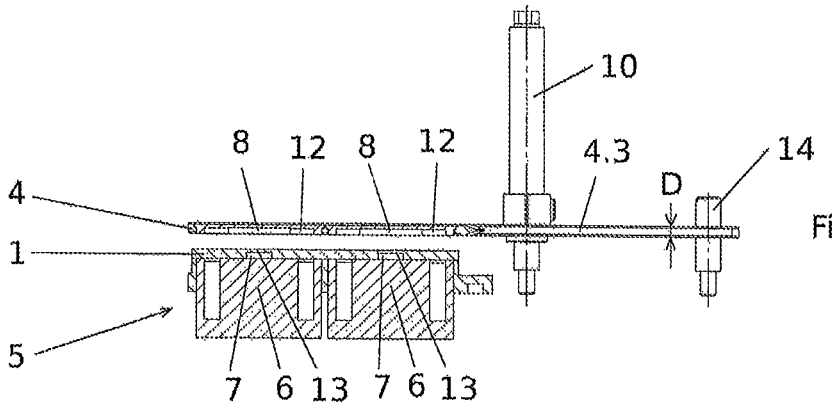
FIG. 3 is a cross-sectional view of the plate element and adjustment device (also separated from the rest of the machine).

Regarding the vertical adjustment device 5 (see FIG. 3) which forms a part of support surface 1, when viewed more closely the following further features are provided, and their method of operation will be explained in greater detail later in this document:

As may be seen in FIG. 3, vertical adjustment device 5 is equipped with an electromagnet 6 for adjusting the position of plate element 4, and, which is essential for the invention, plate element 4 is equipped with a magnet 8, particularly a permanent magnet, which cooperates with electromagnet 6. In addition, vertical adjustment device 5 is preferably also provided with an additional permanent magnet 7, wherein the permanent magnet 7 of vertical adjustment device 5 is arranged between electromagnet 6 of the vertical adjustment device and magnet 8 arranged on plate element 4.

It is additionally preferably provided that the magnet 8 on plate element 4, which is preferably surrounded by an iron ring 12, and permanent magnet 7 of vertical adjustment device 5 are in a repelling position with respect to one another (that is to way with like poles facing). In addition, a non-magnetisable separating layer 13 is preferably arranged between permanent magnet 7 of vertical adjustment device 5 and the magnet 8 on plate element 4, to preclude the undesirable possibility of direct contact between the magnets, which would be difficult to separate.

Figure 2:
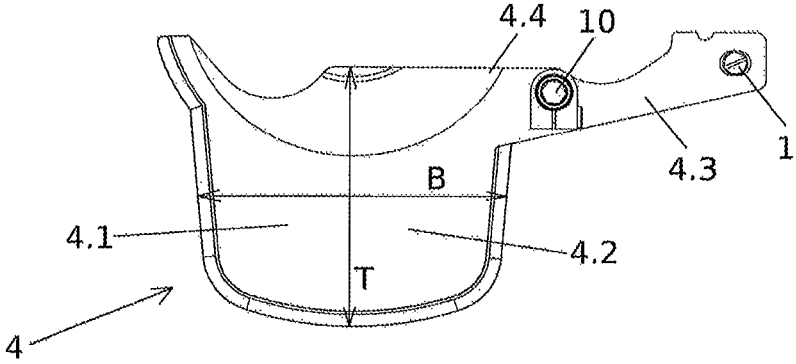
FIG. 2 is a top view of the plate element with retaining element and rotation lock.

In order to be able to influence the feed of the material plies to sewing mechanism 3 particularly effectively, it is also particularly preferably provided—as is also represented in FIGS. 2 and 3—that vertical adjustment device 5 is designed to adjust the vertical distance between support surface 1 and two different areas 4.1, 4.2 of plate element 4, wherein the two areas 4.1, 4.2 of plate element 4 are particularly preferably arranged on either side of a notional line extending parallel to the material feed direction and ending at a needle of sewing mechanism 3.

The earlier specification according to which the vertical adjustment device 5 that is controlled by machine controller 2 is equipped with an electromagnet 6, a permanent magnet 7, a magnet 8, etc., it is thus to be understood with regard to the two areas 4.1, 4.2 of plate element 4 that at least one of each of these components—in the preferred solution at least two thereof—is present, but it is also possible for more than two of each to be present, depending on requirements.

As is also shown in FIGS. 2 and 3, plate element 4 preferably has an area 4.3 that is untouched by the material plies while they are being sewn together, and at this point (on the side) the plate element is attached to support surface 1 via a preferably vertically constructed retaining element 10. At the same time, a rotation lock 14 is preferably still arranged between support surface 1 and plate element 4 to prevent its rotation about a vertical axis.

The sewing machine according to the invention functions as follows:

The two material plies to be sewn together, consisting of different materials as is often the case with car seats, for example, are positioned in the sewing machine in basically normal manner, the only difference being that the lower material ply is positioned between support surface 1 and plate element 4, and the upper material ply is positioned between plate element 4 and abutment 9 (in this case top guide element 12). A material edge detecting device provided or mounted in known manner on the sewing machine detects the edges of the material plies, which are furnished with markings so that they are accordingly positioned precisely at the start of the seam.

Now when the sewing process begins, the edges are detected progressively with the aid of the material edge detecting device. If it should happen that they are no longer properly positioned relative to each other, plate element 4 is actuated correspondingly with the aid of vertical adjustment device 5, so that either the upper or the lower material ply is slowed down, and also steered in a desired direction with the aid of the two areas 4.1, 4.2 of the plate element.

At the same time, retaining element 10 ensures that plate element 4 is configured to be adjustable vertically at all times, while rotation lock 14 further ensures that plate element 4 is not able to rotate about the vertical axis of retaining element 10.

Permanent magnets 7 and 8, which are positioned so as to be constantly repelling one another, cause plate element 4 to be suspended above support surface 1 if electromagnet 6 is not exerting attraction thereon (that is to say it is not polarised in either direction. i.e. it is switched off), that is to say the forces of permanent magnets 7 and 8 are exactly dimensioned to overcome the force of gravity acting on plate element 4, whilst electromagnet 6 is significantly more powerful than permanent magnets 7 and 8, and accordingly either attracts or repels permanent magnet 8 depending on its polarity, wherein the forces of electromagnet 6 and permanent magnet 7 combine to operate subtractively in the first case and additively in the second.

Now if it is intended to influence the position of the material plies with respect to each other due to a relative shift of the edges, the signal from the material edge detection device is evaluated correspondingly and a suitable signal for controlling one or both electromagnets is calculated, and this results in either the upper or the lower material ply being slowed down in the respective area 4.1 or 4.2 At the same time, electromagnets 6 may also even be actuated so as to have opposite polarity to one another, depending on the requirement and with the corresponding result on the guidance of the material plies. The final result of all this, according to the associated experiments carried out by the applicant, is that the material plies can be sewn together very precisely along the edges thereof.

REFERENCE LIST

1 Support surface
2 Machine controller
3 Sewing mechanism
4 Plate element
4.1 Area of the plate element touched by the material
4.2 Area of the plate element touched by the material
4.3 Area of the plate element untouched by the material
4.4 Abutment surface
5 Vertical adjustment device
6 Electromagnet
7 Permanent magnet
8 Magnet

9 Abutment
10 Retaining element
11 Top guide element
12 Iron ring
13 Separating layer
14 Rotation lock
B Width
T Depth
D Thickness

The invention claimed is:

1. A sewing machine comprising a support surface (1) for two plies of material to be sewn together and a sewing mechanism (3) that is attached to the support surface (1) and is in operative connection with a machine controller (2), wherein a plate element (4) positioned between the two material plies is arranged in the material feed area thereof, wherein a vertical adjustment device (5) for the plate element (4) that is actuatable by the machine controller (2) is provided to adjust a vertical distance between the support surface (1) and the plate element (4), and thus also to influence the feed of material to the sewing mechanism (3), wherein the vertical adjustment device (5) is equipped with an electromagnet (6) for adjusting the position of the plate element (4), wherein the plate element (4) is equipped with a magnet (8), which cooperates with the electromagnet (6).

2. The sewing machine according to claim 1, wherein the vertical adjustment device (5) is also equipped with a permanent magnet (7).

3. The sewing machine according to claim 1, wherein the magnet (8) is designed as a permanent magnet.

4. The sewing machine according to claim 1, wherein the vertical adjustment device (5) forms a part of the support surface (1).

5. The sewing machine according to claim 1, wherein the plate element (4) is arranged between the support surface (1) and the abutment (9).

6. The sewing machine according to claim 1, wherein the vertical adjustment device (5) is designed to be able to adjust the vertical distance between the support surface (1) and two different areas (4.1, 4.2) of the plate element (4).

7. The sewing machine according to claim 6, wherein the two areas (4.1, 4.2) of the plate element (4) are arranged on either side of a notional line extending parallel to the material feed direction and ending at a needle of sewing mechanism (3).

8. The sewing machine according to claim 1, wherein the plate element (4) has an area (4.3) that is untouched by the material plies while they are being sewn together, and at this point the plate element is attached to support surface (1) via a retaining element (10) preferably constructed as a vertical guide.

9. A method for operating the sewing machine according to claim 1, wherein the vertical distance between the support surface (1) and the plate element (4) is reduced to slow the lower material ply and increased to slow the upper material ply.

* * * * *